US007331822B2

(12) United States Patent
Chen n

(10) Patent No.: US 7,331,822 B2
(45) Date of Patent: Feb. 19, 2008

(54) RECEPTACLE CONNECTOR

(75) Inventor: Chin-Yu Chen n, Taoyuan (TW)

(73) Assignee: Amphenol Taiwan Corporation, Taoyuan (TW)

( * ) Notice: Subject to any disclaimer, the term of this patent is extended or adjusted under 35 U.S.C. 154(b) by 105 days.

(21) Appl. No.: 11/401,865

(22) Filed: Apr. 12, 2006

(65) Prior Publication Data

US 2007/0173118 A1 Jul. 26, 2007

(51) Int. Cl.
*H01R 13/648* (2006.01)

(52) U.S. Cl. ..... 439/607

(58) Field of Classification Search ..... 439/607, 439/357, 358

See application file for complete search history.

(56) References Cited

U.S. PATENT DOCUMENTS 5,304,069 A * 4/1994 Brunker et al. ..... 439/108
6,120,321 A * 9/2000 Wu ..... 439/541.5
6,155,872 A * 12/2000 Wu ..... 439/541.5
6,162,089 A * 12/2000 Costello et al. ..... 439/541.5
6,315,608 B1 * 11/2001 Lopata et al. ..... 439/607
6,447,311 B1 * 9/2002 Hu et al. ..... 439/108
6,814,612 B1 * 11/2004 Hu et al. ..... 439/541.5
7,025,632 B2 * 4/2006 Hu et al. ..... 439/606

* cited by examiner

*Primary Examiner*—Tulsidas C. Patel
*Assistant Examiner*—Harshad Patel
(74) *Attorney, Agent, or Firm*—Troxell Law Office, PLLC

(57) ABSTRACT

A receptacle connector includes a insulative housing having an engaging portion, and a guiding position shield having a locking member wherein the engaging portion is defined as a rectangular groove and the locking member has a barb formed by stamping inward from a surface. In assembly, the barb is against the engaging portion (the rectangular groove) whereby to assemble the insulative housing and the guiding position shield together.

7 Claims, 5 Drawing Sheets

RECEPTACLE CONNECTOR

BACKGROUND OF THE INVENTION

1. Field of the Invention

The present invention relates to a receptacle connector, and particularly to a receptacle connector having a guiding position shield for securely firm with a insulative housing and provide a plug connector with an accurate mating position.

2. Prior Art

With reference to FIG. 1 for a conventional receptacle connector with a guiding position shield, the conventional receptacle connector 5 includes: a housing 50 and a guiding position shield 51, wherein the housing 50 is insulative and formed in low-profile, the housing 50 has a inserting slot 501 for accommodating a plurality of terminals 502 therein, adapted for mating with a plug connector (not shown); the housing 50 further has a locating shaft 503 mounted on a printed circuit board (not shown). The guiding position shield 51 is formed by stamping processing technique and made of metal, having a top face 510 and tow side faces 511, 512. The top face 510 has a tongue 513 extending from a lateral side of the top face 510 being adjacent to the housing 50, the tongue is displaceable in downward direction toward the housing 50, the two side faces 511, 512 respectively have a plurality of mounting legs 516, 517 for mounting on the printed circuit board (not shown). Further referring to FIG. 2, the housing 50 and the guiding position shield 51 can be mounted on a printed circuit board 6 by soldering the locating shaft 503 and the mounting legs 516, 517 on the printed circuit board 6; therefore, a plug connector (not shown) can mate with the receptacle connector 5.

However, considerable problems are often encountered because the housing 50 and the guiding position shield 51 are required to be separately assembled on the printed circuited board 6; furthermore, the shield 51 is generally of slim shape and therefore is not advantage to automatic assembly in grabbing the shield 51 separately. Such assembling process made inclined in the two side faces 511, 512 of the guiding position shield 51 due to the guiding position shield 51 is of only three faces and the two side faces 511, 512 are free. Consequently, a plug connector is unable to be accurately inserted into the inserting slot 501 of the housing 50.

Moreover, the inclined guiding position shield 51 may not be able to use again; thus it is inevitable that assemblers have to keep more stock of the guiding position shield 51 and which increases cost of material. This invention is directed to solving the above-mentioned problems by providing a unique configuration of the guiding position shield of the receptacle connector.

SUMMARY OF THE INVENTION

Accordingly, an object of the present invention is to provide a receptacle connector with a guiding position shield, wherein two side walls of the guiding position shield are firmly engagable with a insulative housing and are retained perpendicularly for providing an appropriate inserting entrance with the plug connector To achieve the above-mentioned object, a receptacle connector in accordance with the present invention includes a insulative housing having an engaging portion, and a guiding position shield having a locking member wherein the engaging portion is defined as a rectangular groove for guiding a locking member to engage with each other. The locking member has a barb formed by stamping inward from a surface of the locking member. In assembly, the barb is against the engaging portion (the rectangular groove) whereby to assemble the insulative housing and the guiding position shield together.

Other objects, advantages and novel features of the present invention will be drawn from the following detailed embodiment of the present invention with attached drawings.

DESCRIPTION OF THE PREFERRED EMBODIMENTS

Figure 1:
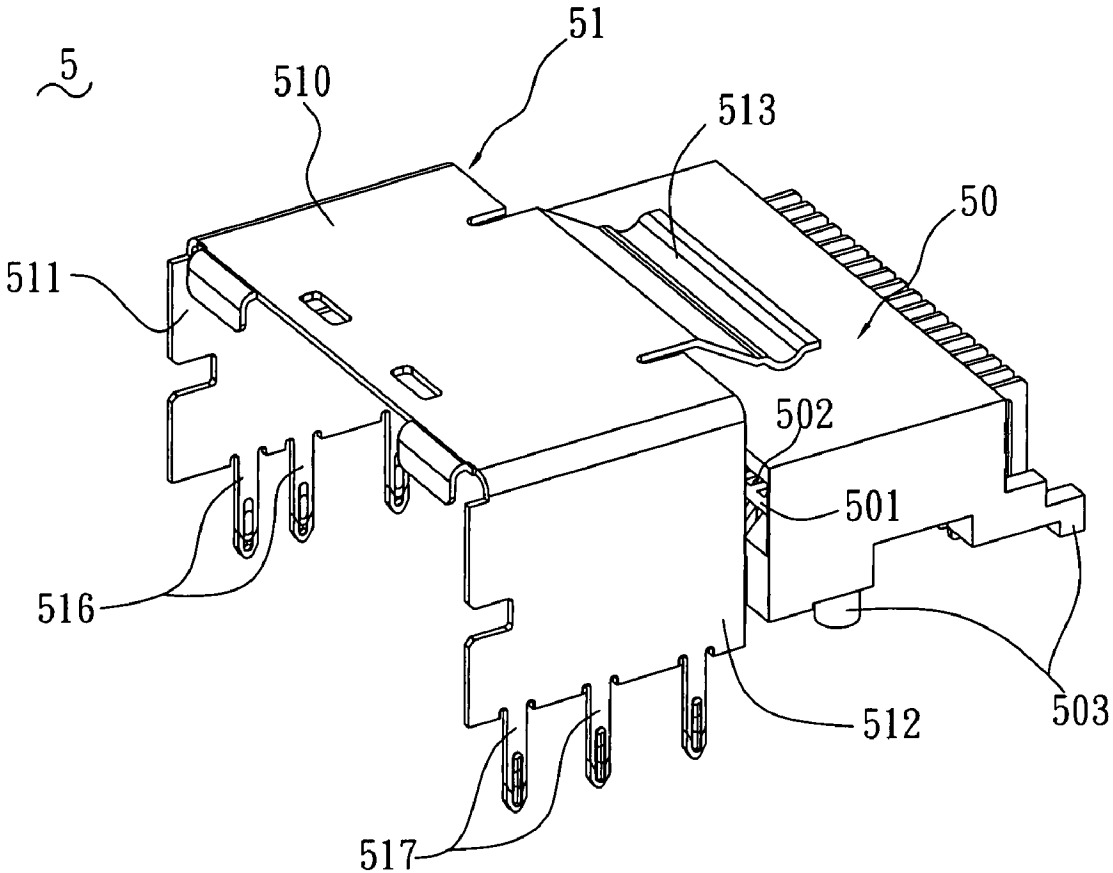
FIG. 1(Prior Art)
FIG. 1 is an perspective exploded view of a receptacle connector of a conventional invention.
Figure 2:
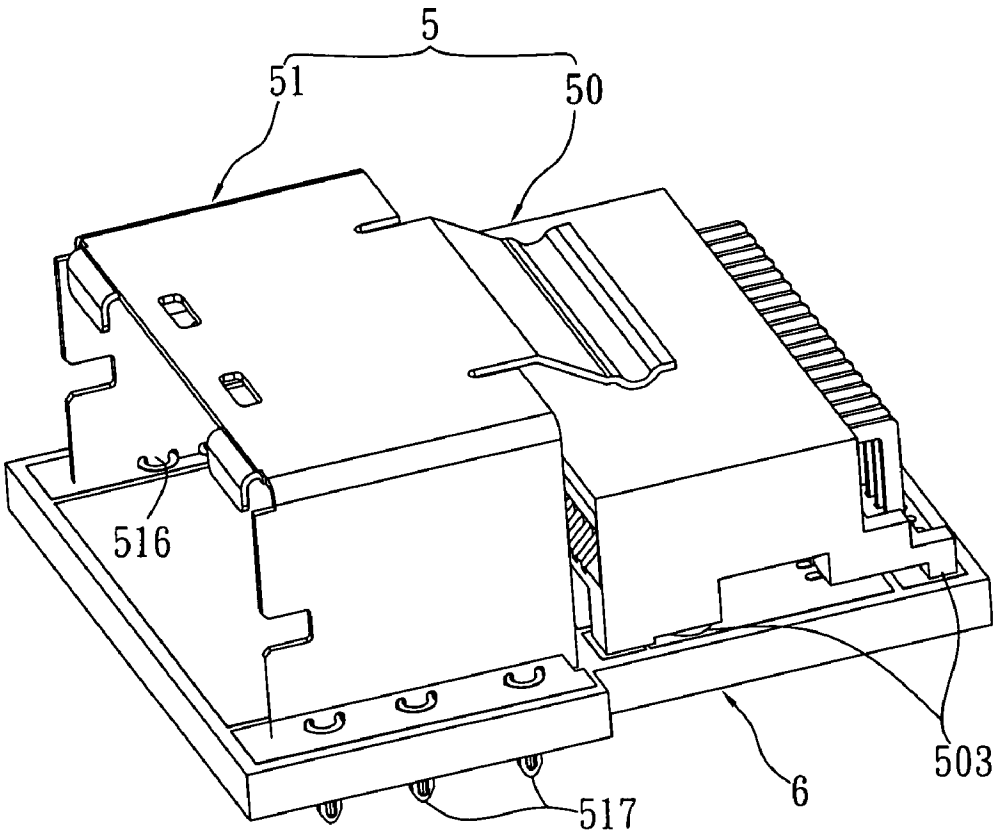
FIG. 2(Prior Art)
FIG. 2 is a perspective assembled view of FIG. 1.
Figure 3:
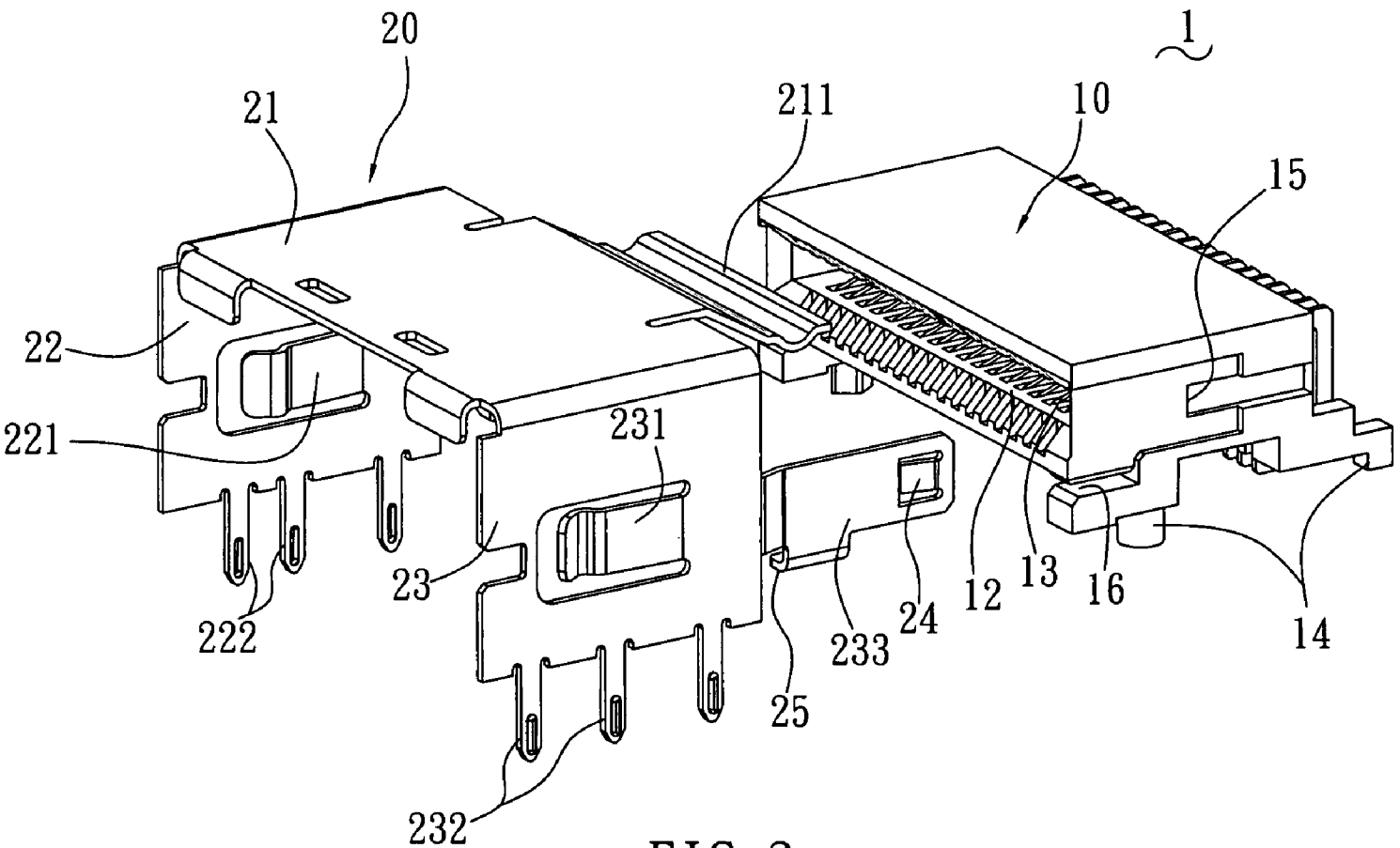
FIG. 3 is a perspective exploded view of a receptacle connector of the present invention.

Referring to FIG. 3, a receptacle connector 1 of the present invention includes an insulative housing 10 and a guiding position shield 20, the insulative housing 10 is formed in low-profile and has a mating slot 12 for accommodating a plurality of terminals 13 therein. The mating slot 12 is adapted for insertion of a plug connector (not shown). A locating posts 14 are disposed bottom edge of lateral sides of the insulative housing 10 and mounted on a printed circuit board (not shown). An engaging portion 15 is integrally formed on lateral sides of the insulative housing and defined as a rectangular groove for guiding a locking member 233 (described below) to engage with each other. Moreover, a recess 16 is defined between the mating slot 12 and the locating posts 14 of the insulative housing 10.

The guiding position shield 20 formed by stamping processing technique and made of metal, having a top wall 21, two side walls 22, 23, and locking members 223, 233. The top wall 21 has a first tongue 211 integrally extending from the top wall 21, the first tongue 211 is in downward direction for reinforcing an engagement with the plug connector. The two side walls 22, 23 of the guiding position shield 20 respectively have a second tongue 231 and a third tongue 221, wherein both the second and third tongues 231, 221 are integrally formed by stamping processing technique from a surface of the two side walls 23, 22, respectively. The second and third tongues 231, 221 are displaceable in inward direction for reinforcing an engagement with the plug connector as the plug connector is inserted into the mating slot 12 of the housing 10. Furthermore, the two side walls 22, 23 respectively have a plurality of position legs 232 extending from bottom edges thereof. The position legs 232 are mounted on the printed circuited board. Further referring to FIG. 6 in combination of FIG. 3, the locking members 223, 233 integrally extends from lateral sides of the two side walls and are of rectangular shape and having a barb 24 is formed by stamping inward from a surface of the locking members 223, 233 for engaging with the engaging portions 15 of the insulative housing 10. The locking members 223, 233 further have a protrusion arm 25 disposed away from the barb 24 and corresponding to the recess 16 of the insulative housing 10.

Figure 6:
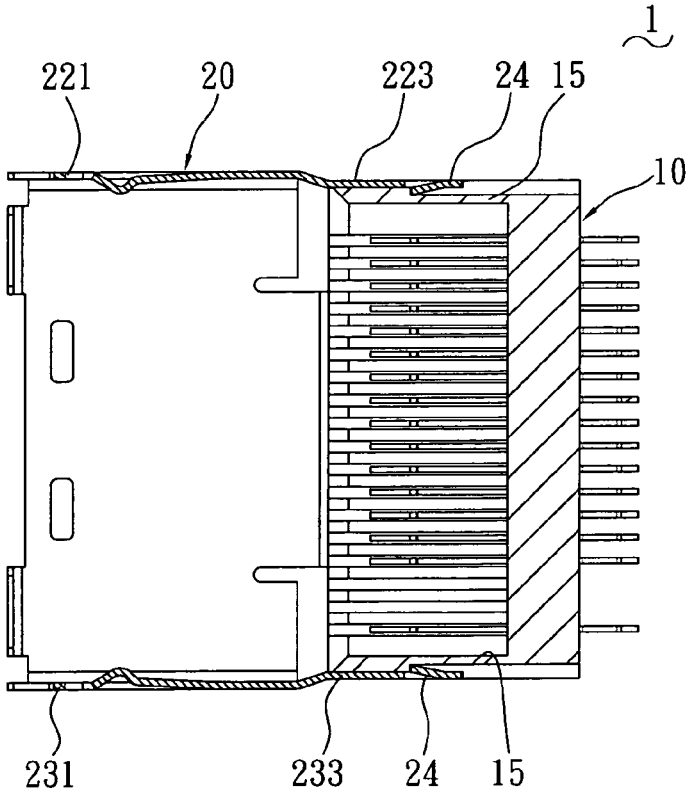
FIG. 6 is a cross-sectional view taken along ling 6-6 of FIG. 5.

Referring to FIG. 6, the receptacle connector 1 of the present invention, in assembly, a free end of the barb 24 is against the engaging portion 15 (the rectangular groove) of the insulative housing 10 whereby to assemble the insulative housing 10 and the guiding position shield 20. Moreover, the protrusion arm 25 is transversally inserted into the recess 16 whereby to further reinforce a firm engagement of the insulative housing 10 and the guiding position shield 20. Therefore, the coupled insulative housing 10 and guiding position shield 20 are able to avoid loosening or disengaging when the plug connector is inserted, and the two side walls 22, 23 of the guiding position shield 20 are retained perpendicularly for providing an appropriate inserting entrance with the plug connector.

Figure 4:
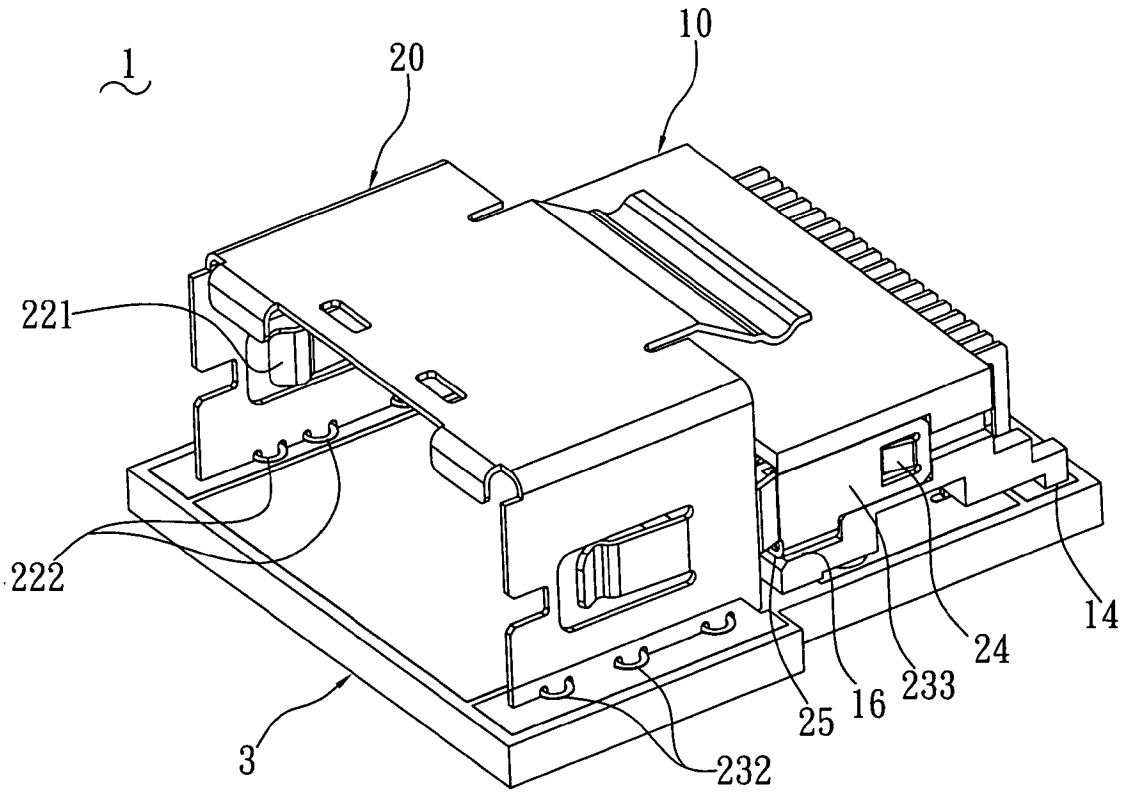
FIG. 4 is a perspective assembled view of FIG. 3.
Figure 5:
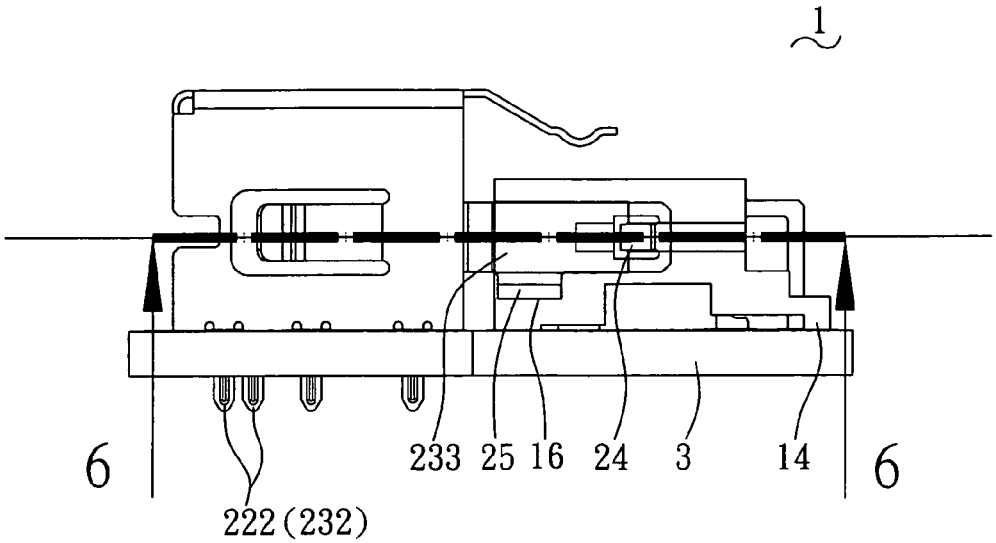
FIG. 5 is a right elevational view of FIG. 4.

Referring to FIGS. 4 and 5 showing the assembled insulative housing 10 and the guiding position shield 20, assemblers can grab the assembled insulative housing 10 and the guiding position shield 20 together, and then assemble and position the receptacle connector 1 on the printed circuited board by way of the locating posts 14 of the insulative housing 10 and the position legs 232 of the guiding position shield 20. Accordingly, an assembling process is simplified because the assemblers do not need to separately assemble the housing 10 and guiding position shield 20 on the printed circuited board.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A receptacle connector comprising:

a) an insulative housing having:

i) a mating slot;

ii) a plurality of terminals located in the mating slot;

iii) two engaging portions, one of the two engaging portions is located on each of two opposing sides of the insulative housing; and iv) a plurality of locating posts located on a bottom edge of each of the two opposing sides of the insulative housing; and b) a guiding position shield made of metal and having:

i) a top wall;

ii) two side walls extending downwardly from the top wall;

iii) two locking members, one of the two locking members is connected to each of the two side walls and extending outwardly from a rear of the housing, each of the two locking members engaging one of the two engaging portions;

iv) a first tongue connected to the top wall and extending outwardly from the rear of the housing; and v) a plurality of positioning legs extending from bottom edges of the two side walls.

2. The receptacle connector according to claim 1, wherein each of the two engaging portions is a rectangular groove integrally formed in the opposite side of the housing.

3. The receptacle connector according to claim 2, wherein each of the two locking members has a barb having a rectangular shape engaging the rectangular groove.

4. The receptacle connector according to claim 3, wherein the insulative housing has two recesses, each of the two locking members has a protrusion arm spaced apart from the barb and inserted into one of the two recesses of the insulative housing.

5. The receptacle connector according to claim 4, wherein the protrusion arm of each of the two locking members is positioned perpendicular to the two locking members and extending inwardly toward an interior of the guiding position shield.

6. The receptacle connector according to claim 1, wherein each of the two engaging portions has a width greater than a width of the each of the two locking members.

7. The receptacle connector according to claim 1, wherein each of the two side walls has a side wall tongue being displaced inwardly.

* * * * *